US006505575B1

(12) United States Patent
Ciari

(10) Patent No.: US 6,505,575 B1
(45) Date of Patent: Jan. 14, 2003

(54) LOCATION INDICATOR AND METHOD

(76) Inventor: James R. Ciari, 2261 S. Lincoln St., Denver, CO (US) 80210

( * ) Notice: Subject to any disclaimer, the term of this patent is extended or adjusted under 35 U.S.C. 154(b) by 0 days.

(21) Appl. No.: 09/785,086

(22) Filed: Feb. 20, 2001

(51) Int. Cl.[7] ..... G01D 21/00
(52) U.S. Cl. ..... 116/209; 40/586
(58) Field of Search ..... 116/209, 210, 116/200, 278, 173, DIG. 8, DIG. 9; 40/586, 212, 602

(56) References Cited

U.S. PATENT DOCUMENTS

| | | | | |
|---|---|---|---|---|
| 2,646,019 A | | 7/1953 | Chetlan | |
| 2,949,094 A | | 8/1960 | Clothier | |
| 2,971,206 A | | 2/1961 | Linn | |
| 3,007,437 A | | 11/1961 | Adair | |
| 3,132,626 A | * | 5/1964 | Reid | 116/210 |
| 3,428,019 A | | 2/1969 | Tillay et al. | |
| 3,735,723 A | * | 5/1973 | Lutz | 116/124 B |
| 4,114,561 A | | 9/1978 | Asaro | |
| 4,598,661 A | | 7/1986 | Roe | |
| 4,635,754 A | | 1/1987 | Aschauer et al. | |
| 4,919,452 A | | 4/1990 | Cimino | |
| 5,000,482 A | | 3/1991 | Cimino | |
| 5,058,524 A | | 10/1991 | Guthrie, Jr. | |
| 5,114,369 A | | 5/1992 | Coffey | |
| 5,421,287 A | | 6/1995 | Yonover | |
| 5,555,839 A | | 9/1996 | Staten et al. | |
| 5,710,543 A | * | 1/1998 | Moore | 340/691 |
| 5,804,829 A | * | 9/1998 | Palmer | 250/504 H |
| 5,839,931 A | * | 11/1998 | Shich | 441/6 |
| 6,158,380 A | * | 12/2000 | Aschauer et al. | 116/210 |
| 6,178,915 B1 | * | 1/2001 | Salandra | 116/210 |
| 6,223,682 B1 | * | 5/2001 | Venier | 116/209 |

* cited by examiner

*Primary Examiner*—Christopher W. Fulton
*Assistant Examiner*—Tania Courson
(74) *Attorney, Agent, or Firm*—Harold A. Burdick

(57) ABSTRACT

A user deployed, passive location indicator and method are disclosed, the location indicator including a body mountable carriage, a castable disk releasably engageable at the carriage, and a light weight streamer material associated at one end with the carriage and at its opposite end with the disk. The streamer material is stored in a chamber at one or the other of the carriage or the disk when they are engaged, and is unfurled when the disk is disengaged from the carriage by the user and cast away from the carriage (and thus away from the user).

19 Claims, 5 Drawing Sheets

LOCATION INDICATOR AND METHOD

FIELD OF THE INVENTION

This invention relates to passive emergency locating systems and methods, and, more particularly, relates to location indicators and methods for use where avalanche danger exists.

BACKGROUND OF THE INVENTION

Skiing, snowshoeing, snowmobiling and other outdoor winter activities continue to increase in popularity. With increasing numbers of participants, however, awareness grows of dangers associated with such activities, particularly when conducted in mountainous terrain where the danger of avalanche is ever present.

Unfortunately, snow slides (i.e., avalanches) claim the lives of some winter sport enthusiasts every season. While exposure to avalanche danger is inherent in many of these activities, the toll in human lives could be reduced by proper preparedness. The most common cause of death in an avalanche is suffocation of victims beneath the snow. Therefore, if victims can be more quickly located fewer will die. Any avalanche rescue team well understands the importance of rapid location of victims.

Passive visual locating devices have been heretofore suggested and/or utilized for a variety of applications (see, for example, U.S. Pat. Nos. 5,555,839, 5,421,287, 5,114,369, 5,058,524, 5,000,482, 4,598,661, 3,428,019, 3,007,437, 2,971,206, 2,949,094, and 2,646,019,). In particular, passive systems for use by those exposing themselves to avalanche danger have been suggested (see U.S. Pat. Nos. 4,635,754 and 4,114,561, for example). Such systems typically use balloons which are carried in back packs and are automatically inflatable by a user in an emergency to mark a wearer's location.

While such systems have the advantage of immediate position location of an avalanche victim using the system, the mechanisms required by such systems for automatic inflation make them bulky and inconvenient for users to carry. Moreover, such systems must be maintained and tested frequently, and their use severely limits the user's ability to pack additional gear, thus encouraging a further, though unintended, lack of preparedness by the user.

Active location signaling devices, such as radio beacons and the like, have also been heretofore suggested for use by those engaging in activities which expose them to avalanche danger. While typically compact and light weight, such devices are expensive to own and maintain, and do little to aid those in the immediate vicinity of an avalanche (such as a victim's companions) in quickly locating victims. Even when properly equipped personnel reach the avalanche site, beacon location (and thus victim location) is not as precise as is the case with passive systems, thus leading to further loss of precious minutes before locating the victim.

As may be seen from the foregoing, further improvement of devices and systems for indicating location, particularly where use is intended for those subjected to danger of avalanche, could still be utilized.

SUMMARY OF THE INVENTION

This invention provides a location indicator and method particularly well adapted for outdoor winter activities where avalanche danger may be present. The indicator is inexpensive, compact, light weight and easy to use, requiring little or no maintenance and testing from season to season. Use of the indicator in an emergency provides immediate and precise victim location, thereby reducing the time needed to affect rescue of a user of the indicator.

The location indicator includes a body mountable carriage having an engagement/detachment interface at one surface thereof. A surface of a castable member is engageable by and manually detachable from the interface of the carriage. A length of light weight material is associated at one end with the carriage and at an opposite end with the castable member, the length of material compactly stored at at least one of the carriage and the castable member while the carriage and the castable member are engaged. By detaching the castable member from the carriage and casting it away from the carriage, the length of material is readily unfurled.

The carriage preferably includes a body contoured mount and strapping for maintaining the indicator on a user's body. The mount provides strap securements and has the engagement/detachment interface thereat, the strapping receivable at the securements.

The location indicating method of this invention, for aiding location of an avalanche victim, includes affixing one end of a length of light weight material at the body of a user exposed to potential avalanche danger and affixing the opposite end of the length of material at a castable member carried by the user. Compact storage of the length of material is maintained under normal circumstances, but the length of material may be caused to be unfurled from storage by casting the castable member away from the user's body before an avalanche overtakes the user.

It is therefore an object of this invention to provide an improved location indicator and method.

It is another object of this invention to provide an improved passive location indicator for use by those exposed to danger of avalanche.

It is still another object of this invention to provide a location indicator that is inexpensive, compact, light weight and easy to use, requiring little or no maintenance and testing from season to season.

It is yet another object of this invention to provide an emergency location indicator and method providing relatively immediate and precise victim location.

It is still another object of this invention to provide a location indicator including a body mountable carriage having an engagement/detachment interface, a castable member having a surface engageable by and manually detachable from the interface of the carriage, and a length of light weight material associated at one end with the carriage and at an opposite end with the castable member, the length of material compactly stored at at least one of the carriage and the castable member while the carriage and the castable member are engaged and readily unfurled by detaching the castable member from the carriage and casting the castable member away from the carriage.

It is yet another object of this invention to provide a location indicator including a body mountable carriage with a body contoured mount and strapping for maintaining the indicator on a user's body, the mount having strap securements and an engagement/detachment interface thereat, the strapping receivable at the securements, a castable member having a surface engageable by and manually detachable from the interface of the carriage, and a length of light weight material affixed at one end to the carriage and associated at an opposite end with the castable member, the length of material releasably containable by at least one of the carriage and the castable member.

It is still another object of this invention to provide a location indicating method aiding location of an avalanche victim that includes the steps of affixing one end of a length of light weight material at the body of a user exposed to potential avalanche danger, affixing an opposite end of the length of material at a castable member carried by the user, maintaining compact storage of the length of material under normal circumstances, and causing the length of material to be unfurled from storage by casting the castable member away from the user's body before an avalanche overtakes the user.

With these and other objects in view, which will become apparent to one skilled in the art as the description proceeds, this invention resides in the novel construction, combination, and arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figure 1:
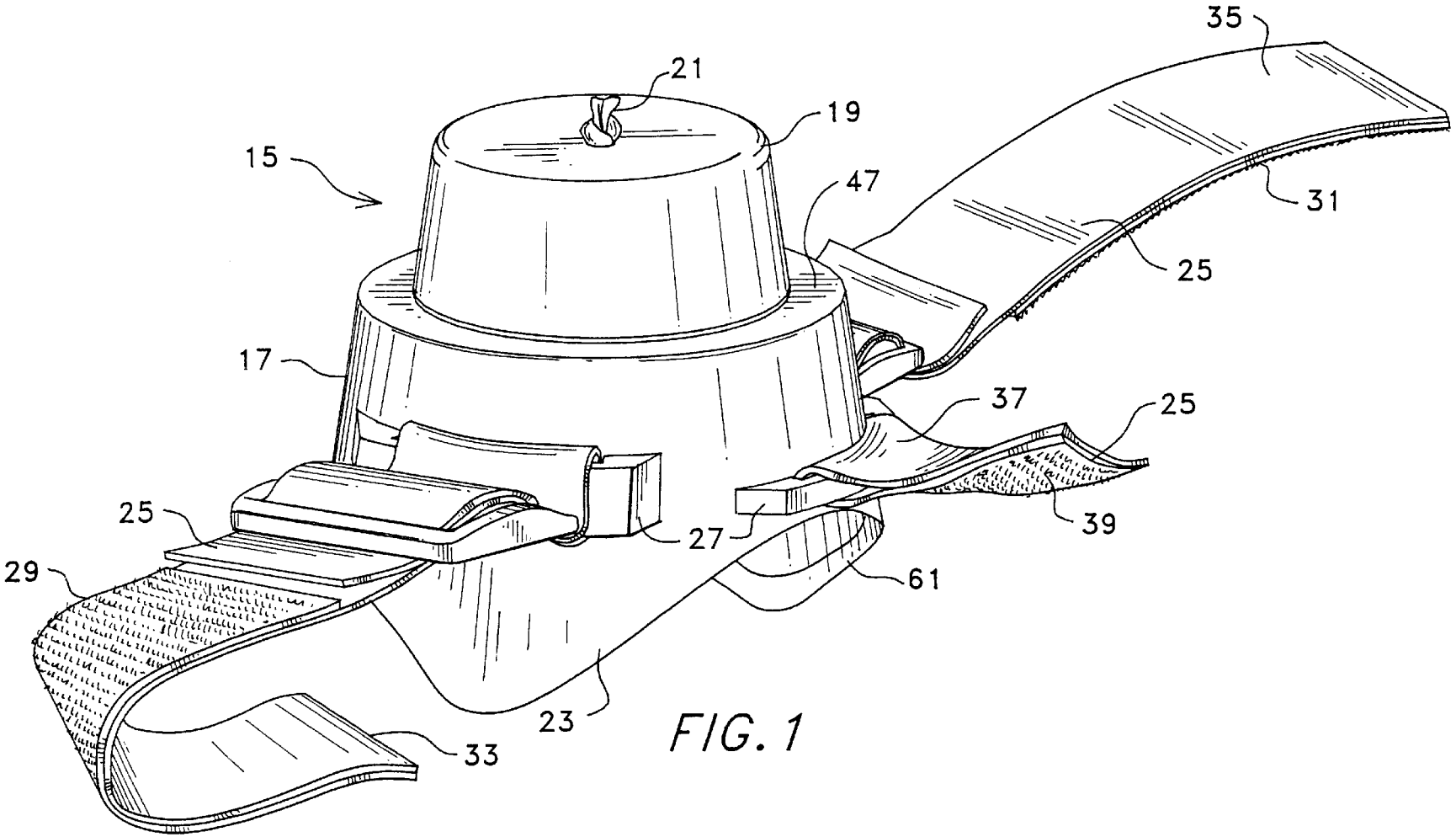
FIG. 1 is a perspective view of a first embodiment of the location indicator of this invention.
Figure 2:
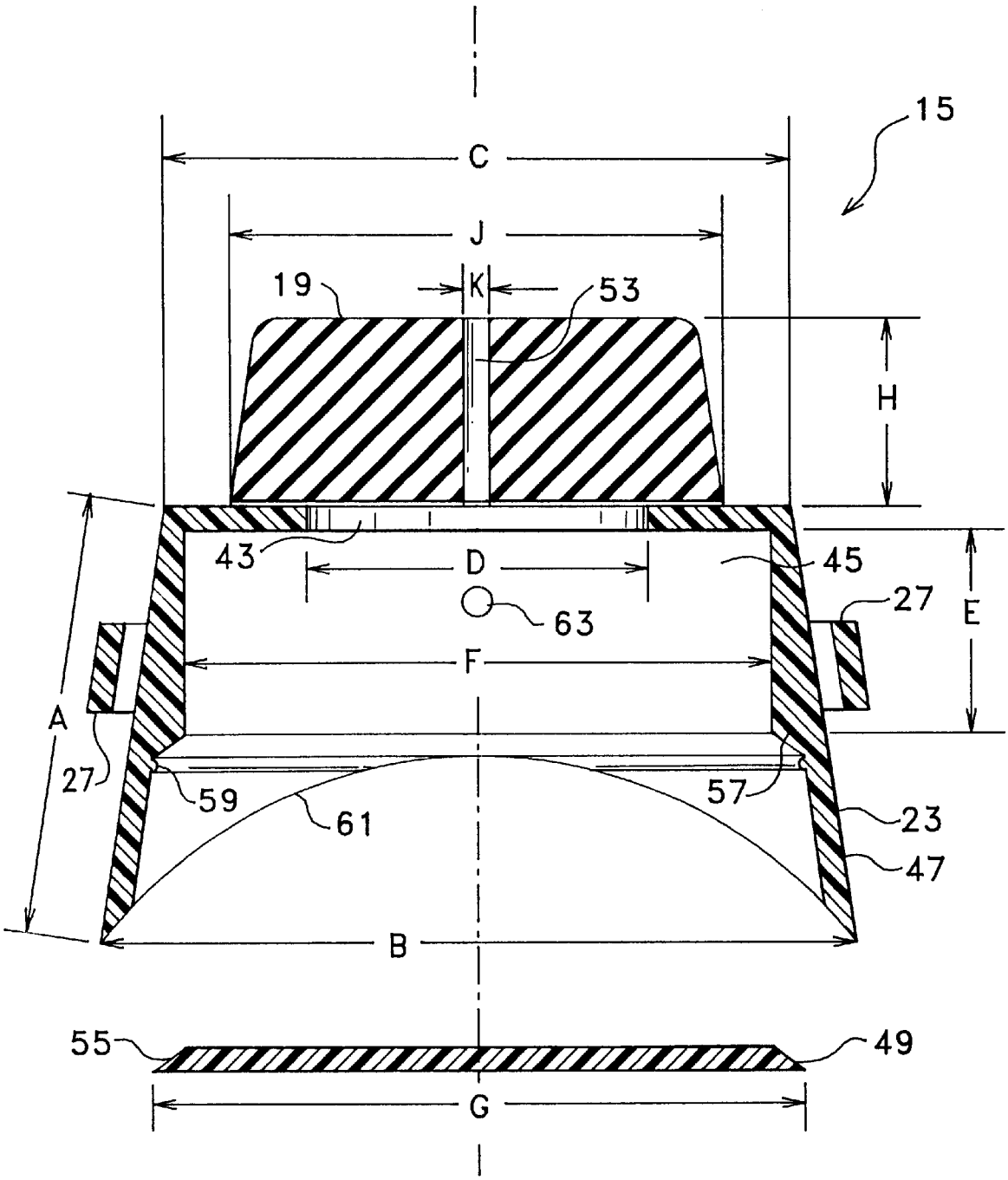
FIG. 2 is a sectional view of portions of the embodiment of this invention shown in FIG. 1.
Figure 3:
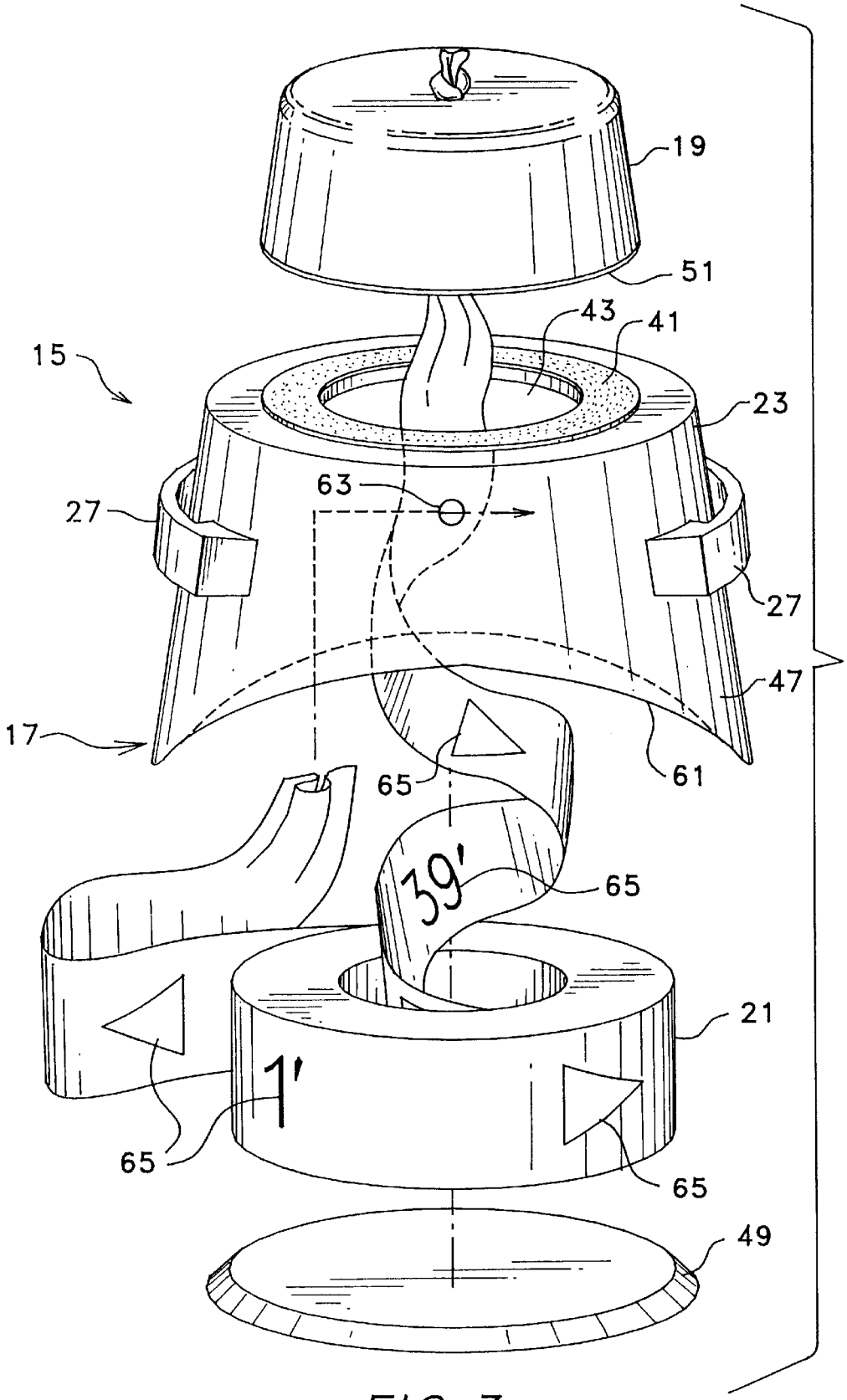
FIG. 3 is an exploded view of the location indicator of FIG. 1.

A first embodiment 15 of the location indicator of this invention is illustrated in FIGS. 1 through 3. Indicator embodiment 15 basically includes three main components: body mountable carriage 17, disk 19 detachable from carriage 17 and castable separately therefrom, and a length of light weight streamer (a tape- or ribbon-like) material 21.

Figure 4:
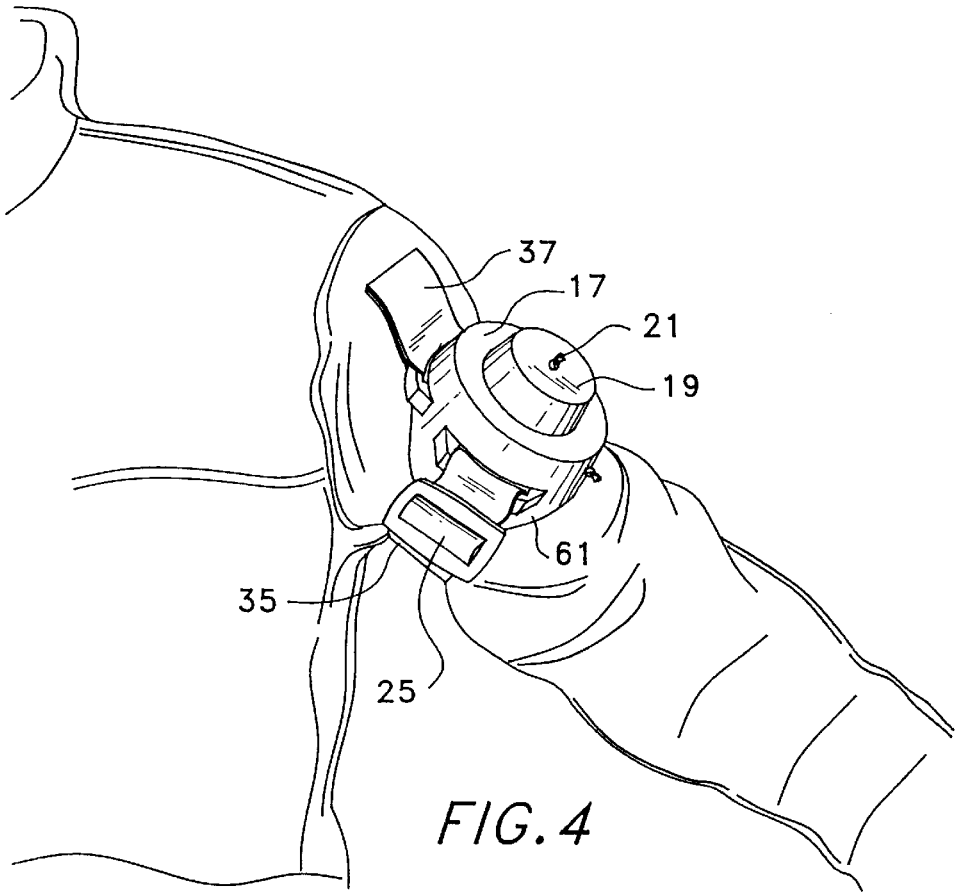
FIGS. 4 and 5 are perspective views illustrating operation of the location indicator of this invention.
Figure 5:
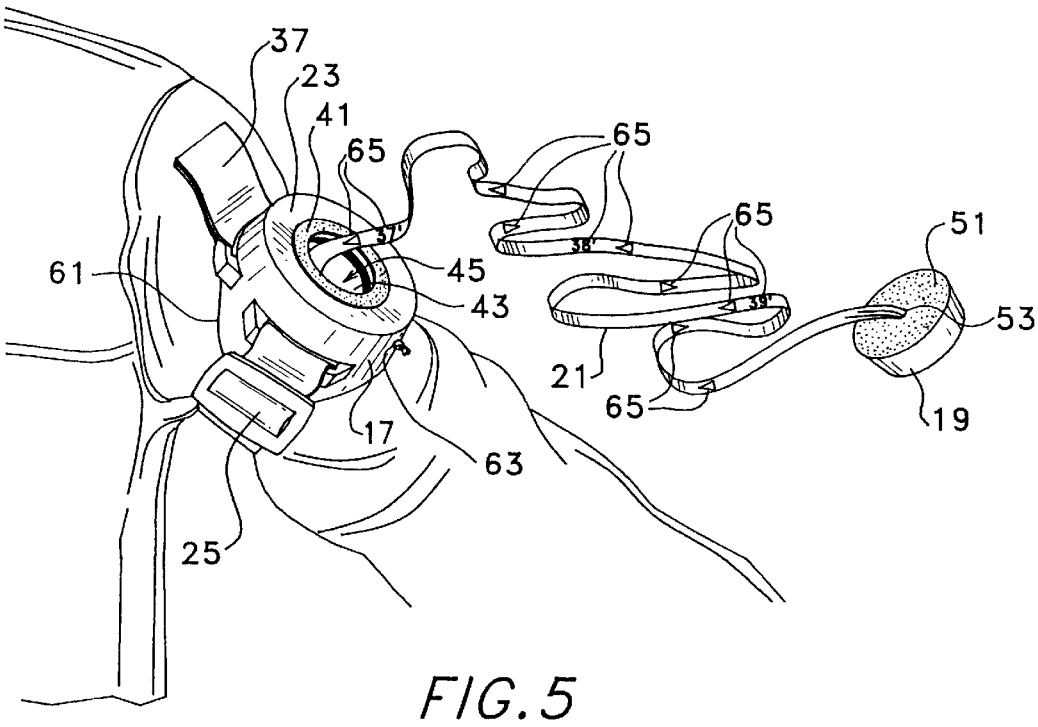

Carriage 17 includes body contoured mount 23 and strapping 25. Mount 23 is formed with securements 27 for strapping 25, which may take any convenient form such as loops, buckles or the like, strapping 25 maintained thereon by buckling, hook and loop fabrics, sewing or in any other secure and durable manner. Strapping 25 preferably is provided with hook and loop material surfaces 29 and 31, respectively, at strap segments 33 and 35 (i.e., first strapping) for enabling adjustable strap securement on the user's body (for example, preferably on the user's upper arm as illustrated in FIGS. 4 and 5, though mount 23 and strapping 25 may be contoured and sized for mounting at different parts of a user's anatomy).

Strap segment 37 (i.e., second strapping), oriented to extend at an angle (about 90°) relative to strap segments 33 and 35, also preferably includes one of the loop and hook material portions at surface 39 thereof to interface with a matable material portion secured at an article of the user's clothing (see FIG. 4), though any interface mechanism (buckles, pins, zippers, snaps, or the like) would be adequate. This arrangement anchors carriage 17 on the user's body against gravitational and other forces causing rotation (along any axis) of the carriage.

Mount 23 includes interface 41 adjacent opening 43 from chamber 45 defined by mount body 47 and bottom closure 49. Chamber 45 is configured to be only slightly larger than the overall dimensions of the coiled streamer material 21 to be stored therein so that coil movement under normal circumstances as the user moves about is minimized. Interface 41 is preferably one portion of a hook and loop material combination, the mating hook and loop material portion applied at surface 51 of disk 19 (see FIGS. 3 and 5). Interface 41 is thus the carriage interface for engagement and detachment of disk 19. Disk 19 includes opening 53 for receipt of streamer material 21 therethrough, material 21 knotted at its end to assure attachment with disk 19.

Bottom closure 49 of mount 23 includes a beveled outer edge 55 and is removably receivable at annular surface 57 of mount body 47, secured thereat by annular lip 59. This arrangement allows placement and replacement after use of the coiled streamer material 21 in chamber 45 (see FIG. 3) and compact storage thereof while carriage 17 and disk 19 are engaged at interface 41 and surface 51, respectively.

Mount body 47 includes lower contoured rim surface 61 opposite interface 41 specially adapted for fit to the part of the user's body on which carriage 17 is to be mounted (as illustrated, for fit to a user's upper arm). Opening 63 from chamber 45 is provided for securement of the opposite end of streamer material 21 therethrough (again, for example by forming a knot after passage of the material through the opening).

Streamer material 21 is preferably provided (at both faces thereof) with direction (to the user wearing carriage 17) and/or distance (from the user wearing carriage 17) indications 65 along the entire length thereof at selected intervals. Streamer material 21 is at least about 40' in length (preferably at least 50' long) and about 1" wide, and made of a high-strength (at least about 90 lb. test), reinforced, flexible and light weight material (such as various industrial nylon materials or the like). The material should be brightly colored, preferably a bright fluorescent.

While carriage 17 and disk 19 may be made of various materials, it is preferred that the carriage material be quite light weight and, particularly in this embodiment, the disk be of a heavier material to assure travel when cast by the user. For example, carriage 17 may be made of PETG (polyethylene terephthalate glycol comonomer, a very light plastic typically utilized for product packaging) while disk 19 may be made of various rubber materials such as polyurethane.

With reference to FIG. 2, while the size and specific shape of carriage 17 and disk 19 may be altered for adaptation to specific mounting locations or the like, carriage 17 may be about 2.34" along its side dimension A, 3.875" in diameter at its base dimension B and 3.25" in diameter along its top dimension C. Opening 43 preferably has about a 1.75" diameter (dimension D) and chamber 45 is preferably about 1.062" (dimension E) by 3.0" in diameter (dimension F). Closure 49 is preferably about 3.34" in diameter at dimension G, the radius of surface 61 being then about 2.375". Disk 19 as shown in the FIGURE would be about 1.0" high (dimension H) with a diameter of about 2.5" at its base (dimension J). Opening 53 would preferably have a diameter of about 0.125" (dimension K).

Turning now to FIGS. 4 and 5, use of embodiment 15 of the location indicator, as well as the method of this invention, are illustrated. The location indicator, with disk 19 engaged at surface 51 with engagement/detachment interface 41 of carriage 17, is secured on the user (herein, on the upper arm of the user's non-throwing hand) and adjusted using strap segments 33 and 35 of strapping 25 so that contoured surface 61 is snug and comfortable. Strap segment 37 is anchored (at its surface 39) as heretofore described to stabilize carriage 17. Thus mounted, streamer material 21 is effectively affixed at one end at the user's body, the opposite end affixed at disk 19 which is carried by the user in that it is releasably affixed at the user's body to carriage 17. Under normal circumstances, compact storage of the coiled streamer material 21 is maintained (in chamber 45 of mount 23 in embodiment 15) as shown in FIG. 4.

Should an avalanche be triggered above the user, the user must grasp disk 19 (with the user's throwing hand) and detach disk 19 from carriage 17 (i.e., dislocate the engaged surface 51 of disk 19 from engagement/detachment interface 41 of carriage 17), thus pulling a length of streamer material 21 out of chamber 45 through opening 43 as illustrated in FIG. 5 (streamer material 21 unfurls from the inside of the coil as shown in FIG. 3). The user then casts disk 19 away from the user's body to fully unfurl streamer material 21.

As is apparent, disk 19 should be cast in a direction roughly perpendicular (i.e., about 90°) to the direction of avalanche travel. The weight of streamer material 21 is selected so that when unfurled it is wafted by air turbulence preceding the leading edge of an avalanche, thereby assuring that at least some portion of streamer material 21 remains above the surface of the snow after the slide passes. After avalanche passage, a visible trace is thus provided by streamer material 21 which may be followed (and read at indications 65) directly to the victim wearing the associated carriage 17.

Figure 6:
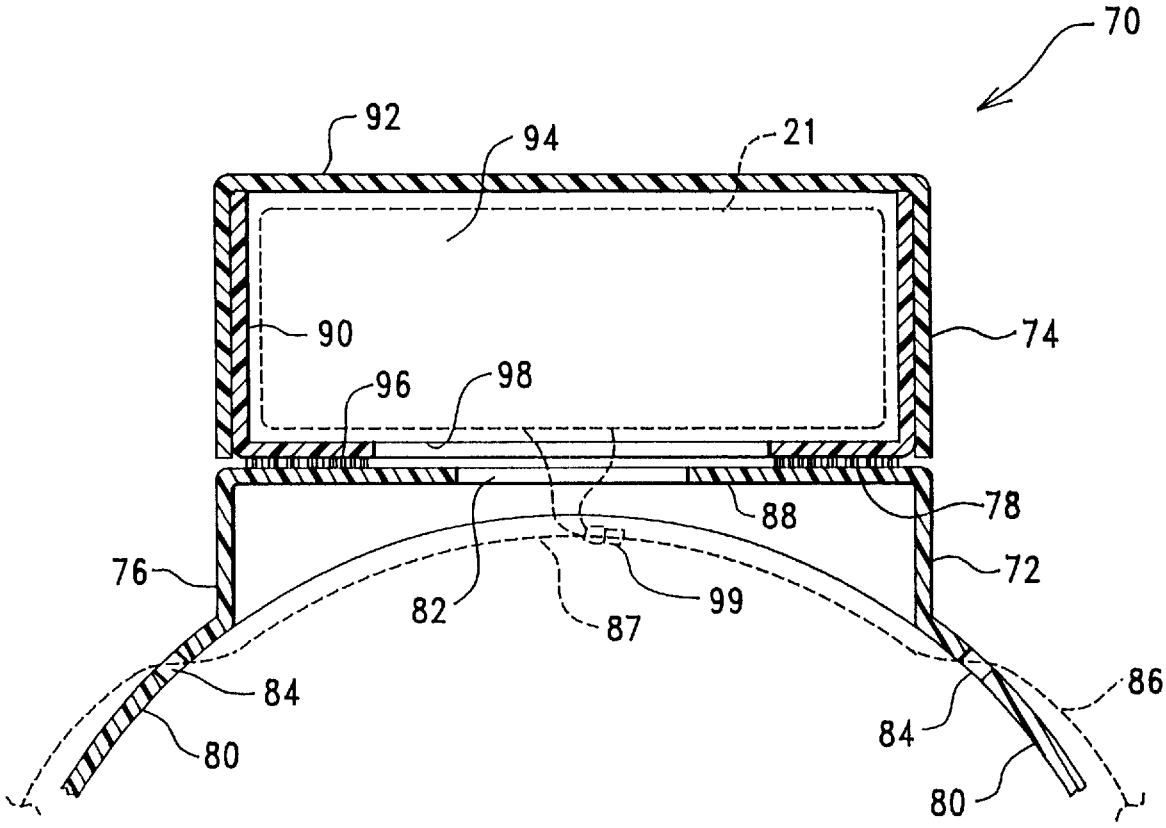
FIG. 6 is a simplified sectional view of portions of a second, and now preferred, embodiment of the location indicator of this invention.

In FIG. 6, a second (and preferred) embodiment 70 of the carriage and disk portions of this invention is shown. Use and operation of a location indicator in accord with this embodiment is no different than use of the prior embodiment as described hereinabove, except as will be made clear as this description proceeds.

As before, the location indicator of this embodiment 70 includes a carriage 72 and castable disk 74 associated at opposite ends of steamer material 21 (suggested in ghosted line in FIG. 6). Carriage 72 includes, as before, body contoured mount 76 having interface 78 and lower contoured rim surface 80 thereat, opening 82 positioned adjacent to interface 78. Securement slots 84 are positioned at rim surface 80 for receipt therethrough of one-piece body securement strapping 86 (illustrated schematically in FIG. 6), a continuous strap segment 87 between slots 84 and adjacent to surface 88 of mount 76 opposite interface 78 thus being provided. The outer ends of rim surface 80 (the terminal ends beyond slots 84 and 86) may have applied thereto a skid proof (friction) material at the inner face thereof to reduce likelihood of rotation of the mounted carriage 72 around the user's body part (i.e., the user's arm). Securement of carriage 72 on a user's body uses the same principles and features as heretofore described.

Disk 74 includes coiled material receptacle portion 90 and cover portion 92 together defining chamber 94 for receipt and storage of coiled streamer material 21. Surface 96 of disk 74 includes material (hook or loop material, for example) releasably engageable at interface 78 of mount 76 of carriage 72 adjacent to opening 98 from chamber 94. Coiled streamer material 21 is connected at one end (leading from the inside loop of the material coil) to strap segment 87 through openings 82 and 98, for example by stitching 99. At its opposite end (leading from the outside loop of the material coil), streamer material 21 may be, but does not necessarily have to be, connected at disk 74, for example clamped between portions 90 and 92. If needed, disk 74 may include a weight or stiffening member mounted in chamber 94 in any convenient manner, though it is felt that the coil of streamer material 21 itself will provide sufficient weight and surface stiffness at disk 74 to accommodate casting of disk 74 the necessary distance in an emergency.

The arrangement of this embodiment 70 decreases the overall size of the location indicator and allows both carriage 72 and disk 74 to be fabricated from the same light weight plastic material, thus further lowering the overall weight of the location indicator and promoting wafting of streamer material 21 when unfurled.

As may be appreciated from the foregoing descriptions, combined storage of streamer material 21 in chambers in both the carriage structure and disk structure could be utilized (i.e., using a carriage 17 type of structure in combination with a disk 74 type of structure). Moreover, while various shapes are implied by use of terms such as "disk" herein, other shapes and/or configurations of such members could be utilized.

What is claimed is:

1. A location indicator comprising:

a body mountable carriage including an engagement/detachment interface;

a castable member having a surface engageable by and manually detachable from said interface of said carriage and a chamber defined therein with an opening therefrom at said surface; and a length of light weight material associated at one end with said carriage and at an opposite end with said castable member, said length of material maintained within said chamber of said castable member while said carriage and said castable member are engaged and readily unfurled by a user manually detaching said castable member from said carriage and casting said castable member a distance away from said carriage.

2. The location indicator of claim 1 wherein said length of material includes at least one of direction and distance indications therealong.

3. The location indicator of claim 1 wherein said carriage is made of light weight plastic, said carriage including a portion defining a chamber adjacent to said engagement/detachment interface with an opening from said chamber defined at said engagement/detachment interface, said length of material coiled within said chamber while said carriage and said castable member are engaged.

4. The location indicator of claim 3 wherein said castable member is disk shaped and made of heavier material than said carriage.

5. The location indicator of claim 1 wherein said length of material is a fluorescent, coilable, high strength tape at least about 40' in length between said ends.

6. The location indicator of claim 1 wherein said engagement/detachment interface of said carriage and said surface of said castable member each have an opening thereat for receipt of said length of material therethrough.

7. A location indicator comprising:

a body mountable carriage including a body contoured mount and strapping for maintaining said indicator on a user's body, said mount having strap securements and an engagement/detachment interface thereat, said strapping receivable at said securements;

a castable member having a surface engageable by and manually detachable from said interface of said carriage; and a length of light weight material affixed at one end to said carriage and associated at an opposite end with said castable member, said length of material including at least one of direction and distance indications therealong and releasably containable by at least one of said carriage and said castable member, said length of material readily unfurled by a user manually detaching said castable member from said carriage and casting said castable member a distance away from said carriage.

8. The location indicator of claim 7 wherein said mount of said carriage defines a chamber adjacent to said engagement/detachment interface with an opening from said chamber defined at said engagement/detachment interface, said length of material coiled within said chamber while said carriage and said castable member are engaged.

9. The location indicator of claim 7 wherein said strapping includes first strapping engageable around the user's body and second strapping oriented at an angle relative to said first strapping and anchorable at an article of the user's apparel.

10. The location indicator of claim 7 wherein said body contoured mount of said carriage includes a contoured surface opposite said engagement/detachment interface, said contoured surface shaped to receive the user's upper arm thereagainst for snug securement on the user's body thereat.

11. The location indicator of claim 10 wherein said strap securements of said mount of said carriage include first and second slots at said contoured surface, said strapping continuous between said slots and adjacent to an opposite side of said engagement/detachment interface.

12. The location indicator of claim 11 wherein said length of material is affixed at said one end to said strapping of said carriage.

13. The location indicator of claim 11 wherein said castable member has a chamber defined therein with an opening therefrom at said surface, said length of material coiled within said chamber while said carriage and said castable member are engaged.

14. A location indicating method aiding location of an avalanche victim comprising the steps of:

affixing one end of a length of light weight material at the body of a user exposed to potential avalanche danger;

affixing an opposite end of said length of material at a castable member carried by the user;

maintaining compact storage of said length of material under normal circumstances; and causing said length of material to be unfurled from storage by a user manually casting said castable member a distance away from the user's body before an avalanche overtakes the user.

15. The location indicating method of claim 14 wherein the step of causing said length of material to be unfurled from storage by casting said castable member includes casting said castable member at about 90° relative to direction of movement of the avalanche.

16. The location indicating method of claim 16 wherein weight of said length of material is selected so that said unfurled length of material will be wafted by air turbulence preceding the avalanche front.

17. The location indicating method of claim 14 further comprising the step of releasably affixing the castable member on the user's body.

18. The location indicating method of claim 14 wherein the step of maintaining compact storage of said length of material includes storage of said length of material within said castable member.

19. The location indicating method of claim 14 further comprising the step of marking said length of material with at least one of direction and distance indications therealong.

* * * * *